US005140995A

United States Patent [19]

Uhl

[11] Patent Number: 5,140,995

[45] Date of Patent: Aug. 25, 1992

[54] PROTECTIVE DEVICE FOR THE SPINAL COLUMN FOR MOTORCYCLE RIDERS

[75] Inventor: Harald Uhl, Friolzheim, Fed. Rep. of Germany

[73] Assignee: Hein Gericke GmbH & Co. KG, Fed. Rep. of Germany

[21] Appl. No.: 688,083

[22] Filed: Apr. 18, 1991

[51] Int. Cl.[5] ..... A61F 5/37; A41D 13/00

[52] U.S. Cl. ..... 128/846; 2/2; 2/92

[58] Field of Search ..... 128/846, 78, 102.1, 128/103.1, 104.1, 107.1, 874; 2/16, 44, 92, 2; 606/69-71

[56] References Cited

U.S. PATENT DOCUMENTS

| | | | |
|---|---|---|---|
| 2,250,267 | 7/1941 | Lins | 2/44 |
| 2,342,005 | 2/1944 | Mittag | 2/92 |
| 2,418,009 | 3/1947 | Berman | 2/44 |
| 4,599,747 | 7/1986 | Robinson | 2/44 |
| 5,020,156 | 6/1991 | Neuhalfen | 2/92 |
| 5,029,341 | 7/1991 | Wingo, Jr. | 2/44 |
| 5,056,158 | 10/1991 | Lutz | 2/16 |
| 5,065,457 | 11/1991 | Henson | 2/16 |
| 5,072,738 | 12/1991 | Wonder | 2/16 |

FOREIGN PATENT DOCUMENTS

| | | |
|---|---|---|
| 8426849 | 9/1984 | Fed. Rep. of Germany . |
| 3401111 | 7/1985 | Fed. Rep. of Germany . |
| 3533816 | 7/1987 | Fed. Rep. of Germany . |
| 3441876 | 6/1990 | Fed. Rep. of Germany . |

*Primary Examiner*—Michael Brown
*Attorney, Agent, or Firm*—Speckman & Pauley

[57] ABSTRACT

A protective device for the spinal column, particularly as accident protection for motorcycle riders, having a plurality of plate elements positioned one behind the other in a longitudinal direction of the spinal column. The plate elements are made of a deformable material and are arched to form hollow spaces between the plate elements and a basic body to which the elements are secured. The hollow spaces are filled with a shock-absorbing filler body of plastic foam.

40 Claims, 6 Drawing Sheets

PROTECTIVE DEVICE FOR THE SPINAL COLUMN FOR MOTORCYCLE RIDERS

BACKGROUND OF THE INVENTION

1. Field of the Invention

This invention relates to a protective device for the spinal column, in particular, as accident protection for motorcycle riders, having plate elements positioned one behind the other in the longitudinal direction of the spinal column. The plate elements are arched away from the spinal column and are made of a deformable material and supported by a deformable basic body. The plate elements laterally extend past the spinal column and at least partially overlap or are disposed at a short distance from each other.

2. Description of the Prior Art

A protective device for the spinal column is known and has been described and illustrated, for example, in DE 34 41 876 A1. The known protective device for the spinal column is essentially a kidney belt having a plurality of essentially stiff elements disposed above each other. Each element consists of a plate, slightly arched towards the outside, and an end piece formed thereon, which is covered by the adjoining element. Such a protective device for the spinal column is worn on the back as a kidney belt and, in case of a fall, protects it against external forces which might injure the spinal column.

This protective device for the spinal column can be advantageously employed by motorcycle riders. However, the known protective device for the spinal column only operates satisfactorily if the plates, which consist of a rigid or semi-rigid and deformable material, can absorb the energy of the blows completely.

In addition, the plate elements of the known protective device for the spinal column can be destroyed, possibly breaking into parts with poin'ed edges. This often results in serious injuries through cuts, because the soft basic body does not provide sufficient protection against such breakage. In addition, the plate elements absorb the impact energy poorly.

It is an object of this invention to provide a protective device for the spinal column of the previously mentioned type in which the external force effects during a fall are shielded from the spinal column even better and where even the breaking of the plate elements cannot result in injuries due to cuts.

In accordance with this invention, this object is attained with hollow spaces formed between the plate elements and the basic body, which hollow spaces are filled with a shock-absorbing filler body of plastic foam.

In accordance with one embodiment of this invention, the basic body supports such plate elements which, together with the interposed shock-absorbing filler bodies, absorb the greatest portion of the shock energy. Consequently of which their destruction is acceptable. The filler body damps the shock even more by absorbing or redirecting energy during its destruction or deformation. Breaking points of the plate elements do not reach the body of the user directly through the basic body. The filler body between the plate elements and the basic body constitutes an intermediate buffer which catches the broken pieces of the plate elements and shields them from the body in order to prevent injuries due to cuts.

In accordance with another embodiment of this invention in which the basic body has a width which is greater than the width of the plate elements, the plate elements have a concave section, arched away from the spinal column for receiving the filler material, which is laterally followed by a leg which is fixedly connected to the basic body.

In accordance with a preferred embodiment of this invention, each one of the lower edges of the plate elements, which extend crosswise to plate elements the longitudinal extension of the spinal column, has a collar with a greater distance in the direction towards the basic body than the concave section and which partially receives and covers the crosswise extending, upper edge of the adjacent plate element. As a result the plate elements can cover the spinal column continuously with styrofoam. The areas between the plates at the same time define hinges which, however, need not necessarily be connected with each other.

In accordance with another preferred embodiment of this invention, the plate elements have identical shapes.

In order to transfer a portion of the energy of a blow over as large as possible a surface of the back, in accordance with another preferred embodiment of this invention, the areas of the basic body covered by the plate elements have a greater thickness than the area extending beyond the plate elements. In accordance with another embodiment of this invention, the basic body comprises two coinciding pieces of plastic foam layers which are firmly connected to each other by, for example, gluing. In accordance with one embodiment of this invention, the basic body comprises two pieces of a polyethylene layer.

In accordance with a further embodiment of this invention, the side of the plate elements facing the basic body is provided with a covering or a layer of a tear-resistant deformable material. The purpose of the covering or layer is mainly to assure a good connection between the plate elements and the basic body or the filler body in the hollow spaces.

To insert the filler body into the hollow spaces, the filler body is foamed into the concave section of the plate elements and is fixedly connected to it. Alternatively, filler bodies of the plate elements, connected in a row, are combined into a one-piece strip, which is embodied hinge-like between adjoining plate elements. In yet another embodiment of this invention, the filler body supports all of the plate elements in the direction of the basic body where the filler body extends over the lateral legs of the plate elements and forms a level connection surface in the direction of the basic body.

The protective device for the spinal column can be integrated with a jacket as accident protection or can be embodied and worn as a kidney belt.

The invention will be described in detail by means of the exemplary embodiments shown in the drawings. Shown are in:

DESCRIPTION OF THE PREFERRED EMBODIMENTS

Figure 1:
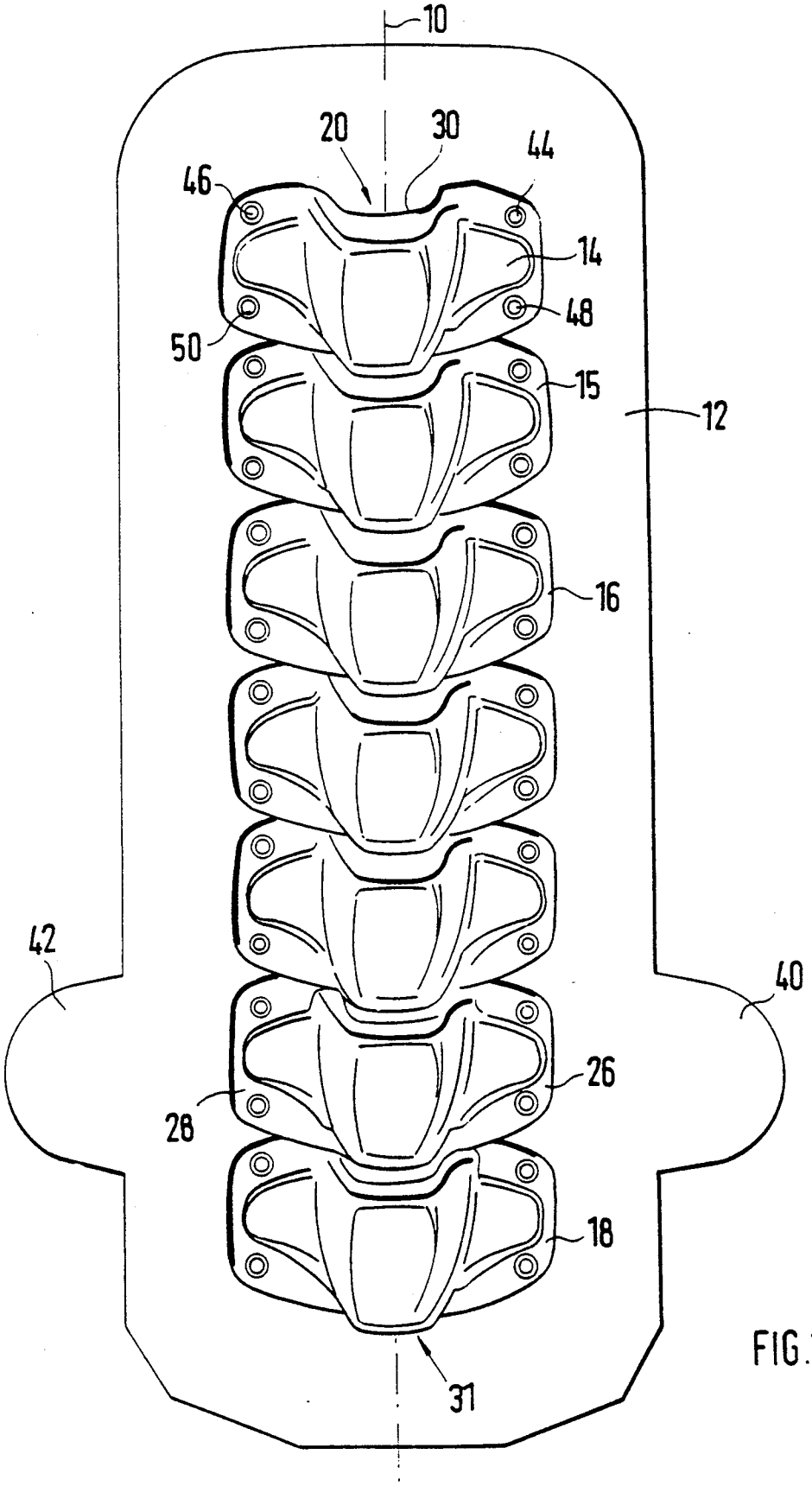
FIG. 1 is a top view of a protective device for the spinal column in accordance with one embodiment of this invention which is suitable to be worn as an insert of a leather jacket.
Figure 2:
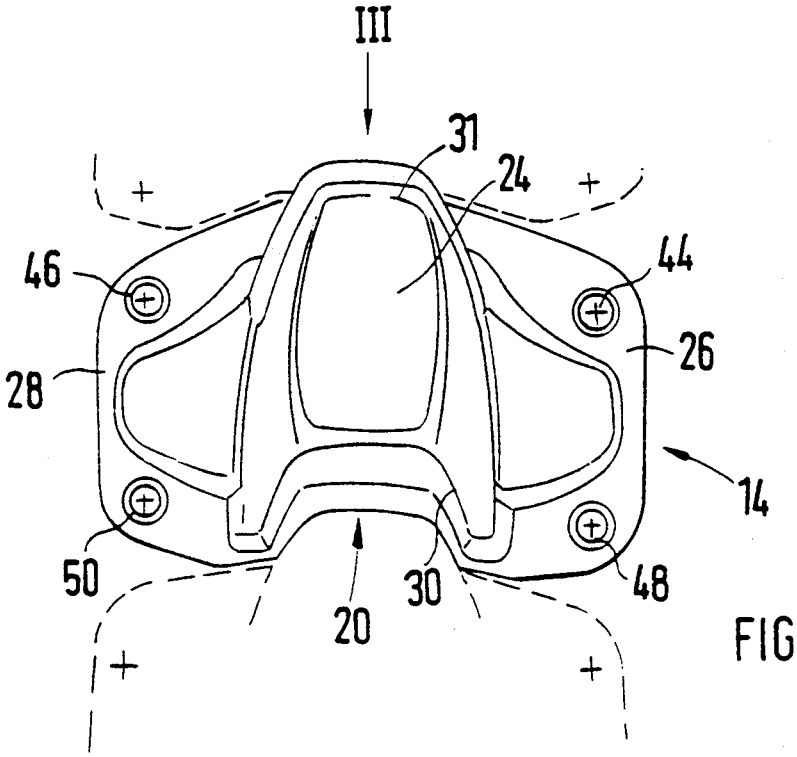
FIG. 2 is a top view of a first exemplary embodiment of a plate element in accordance with one embodiment of this invention.
Figure 3:
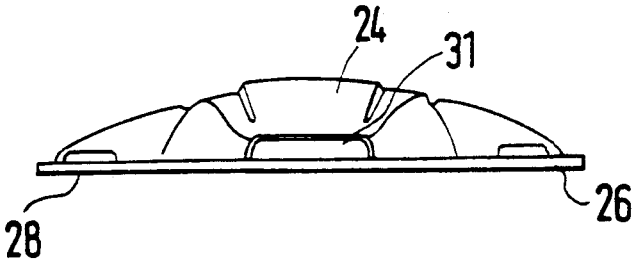
FIG. 3 is a view of the plate element shown in FIG. 2 in the direction of the arrow III.

A protective device for the spinal column which can be inserted into a leather jacket is shown in FIG. 1. The protective device for the spinal column has, positioned one behind the other in the longitudinal extension 10 of the spinal column, plate elements 14, 15, 16 and 18. Plate elements 14, 15, 16, 18 are arched away from the spinal column and are made of a deformable material. Plate elements 14, 15, 16, 18 are supported by an elastically deformable basic body 12 and laterally extend beyond the spinal cord. The adjoining plate elements 14 and 15 overlap on their crosswise extending edges, where, for example, upper plate element, 14, respectively, partially covers lower plate element 15, respectively, of the protective device for the spinal column in accordance with one embodiment of this invention. Hollow spaces 20 are formed between the plate elements 14, 15, 16, 18 and the basic body 12. These hollow spaces 20 are filled with a shock-absorbing filler body 11 of low specific weight. Polystyrene foams, most particularly styropor, are preferred. The basic body 12 has a width which is greater than the width of the plate elements 14, 15, 16, 18. The plate elements, preferably made of an elastic plastic, have a concave section 24 to receive the filler body 11, which is laterally adjoined by legs 26 and 28, which legs 26, 28 are connected to the basic body 12 by rivets 44, 46, 48, 50. The lower, crosswise extending edge of the plate elements 14, 15, 16, 18 have a collar 30, which is at a greater distance from the base body 12 than the concave section 24, so that this collar can receive a tapering section 31 of the adjacent plate element. The concave section 24 is completely filled with the filler body 11 made of polystyrene foam, which can be foamed into the concave section 24 and fixedly connected to the plate elements 14, 15, 16, 18.

FIG. 1 also shows that the individual plate elements 14, 15, 16, 18 themselves are connected to each other in the form of a spinal column, where the tapering section 31 of the one plate element 14, is at least partially received by the collar 30 of the adjoining plate element 15. The plate elements 14, 15, 16, 18 may have different shapes. However, it is essential that they form a hollow space 20 in the direction towards the basic body 12 which can be filled with the filler body 11 composed of a polystyrene foam in a simple manner. In the kidney area, the basic body 12 has two laterally extending legs 40 and 42 which increase the protection of the kidneys and serve as supports for the kidney belt.

In accordance with one embodiment of this invention, the basic body 12 comprises two coinciding pieces of plastic foam layers which are fixedly connected, for example by gluing. In the area of the basic body 12 covered by the plate elements 14, 15, 16, 18 there is a continuous hollow space, which can be filled with a single, elastically deformable strip serving as the filler body 11. This strip can be hinged between adjoining plate elements. The legs 26 and 28, which laterally extend from the concave section 24 of the plate elements 14, 15, 16, 18, rest flush against the basic body 12 and are fixedly connected to it.

Figure 4:
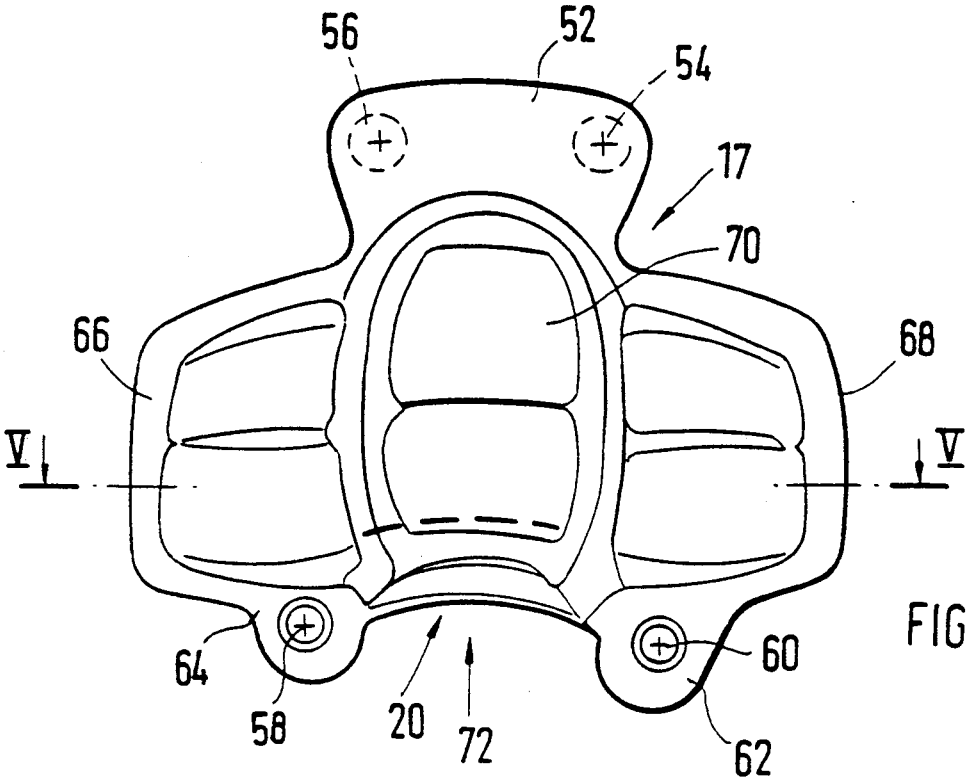
FIG. 4 is a top view of a plate element in accordance with another embodiment of this invention.
Figure 5:
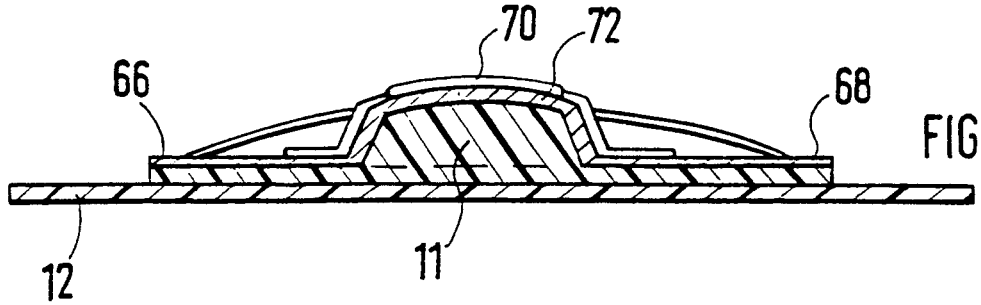
FIG. 5 is a cross sectional view along the line V—V of the plate elements shown in FIG. 4.

FIGS. 4 and 5 show plate element 17 in accordance with another embodiment of this invention. Plate element 17 has a section 70, concavely arched away from the spinal column, which can be filled with a shock-absorbing filler body 11. Two laterally extending legs 66 and 68 adjoin this section 70 and are used for a connection to the basic body 12. On an upper edge of plate element 17, in the axial direction, is a tapering section 52 which is connected to the basic body 12 by rivets 54 and 56. Two additional protrusions 62 and 64 are formed on the lower edge of the plate element 17 and are connected to the basic body 12 by rivets 58 and 60. The elevated collar 72 is formed to cover tapering section 52 of the adjoining plate element.

The filler body 11, composed of shock-absorbing material, can be inserted into each plate element 14, 15, 16, 18 or element plate 70 in such a way that, together with the legs 26 and 28 or 66 and 68, it forms a flat fastening surface in the direction towards the basic body 12, as shown by the section in accordance with FIG. 5. In accordance with one embodiment of this invention, tapering sections 31 or 52 form a continuous hollow space across the protective device for the spinal column into which a strip made of shock-absorbing material as the filler body 11 is inserted, extending across all plate elements. The filler body 11 can also extend over the legs 26 and 28 or 66 and 68 of the plate elements 16 to 18 and in this way can support all of the plate elements in the direction of the basic body 12. This increases the protection against additional injuries in the event the plate elements break.

In accordance with one embodiment of this invention, basic body 12 is made of one or more plastic foam layers. The protective device for the spinal column in accordance with this invention can be inserted into a leather jacket as a unit during its production, however, it also can be made and worn in the fashion of a kidney belt as a part separate from the clothing.

Figure 6:
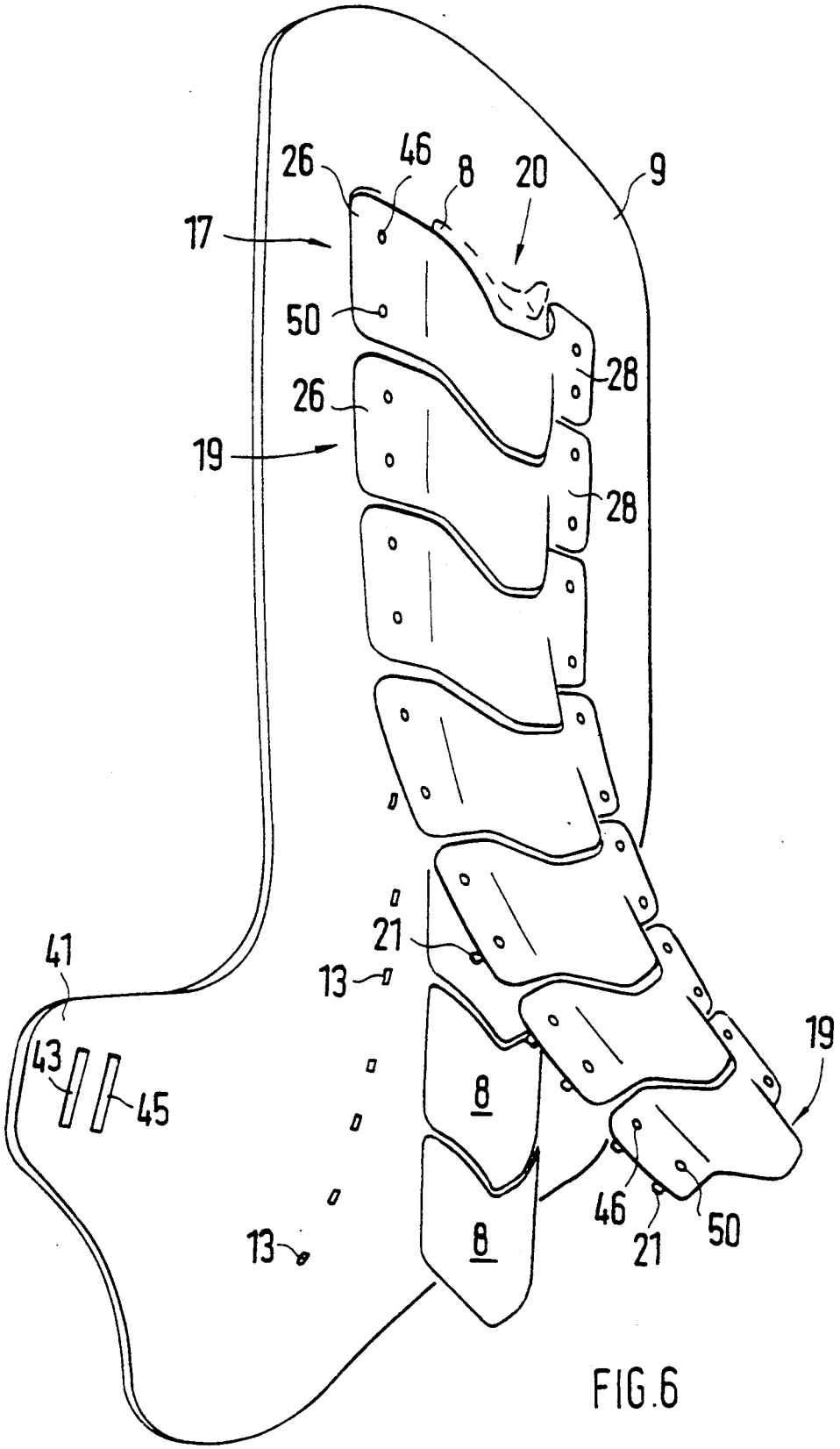
FIG. 6 is a partially exploded view of a protective device for the spinal column in accordance with another embodiment of this invention.
Figure 7:
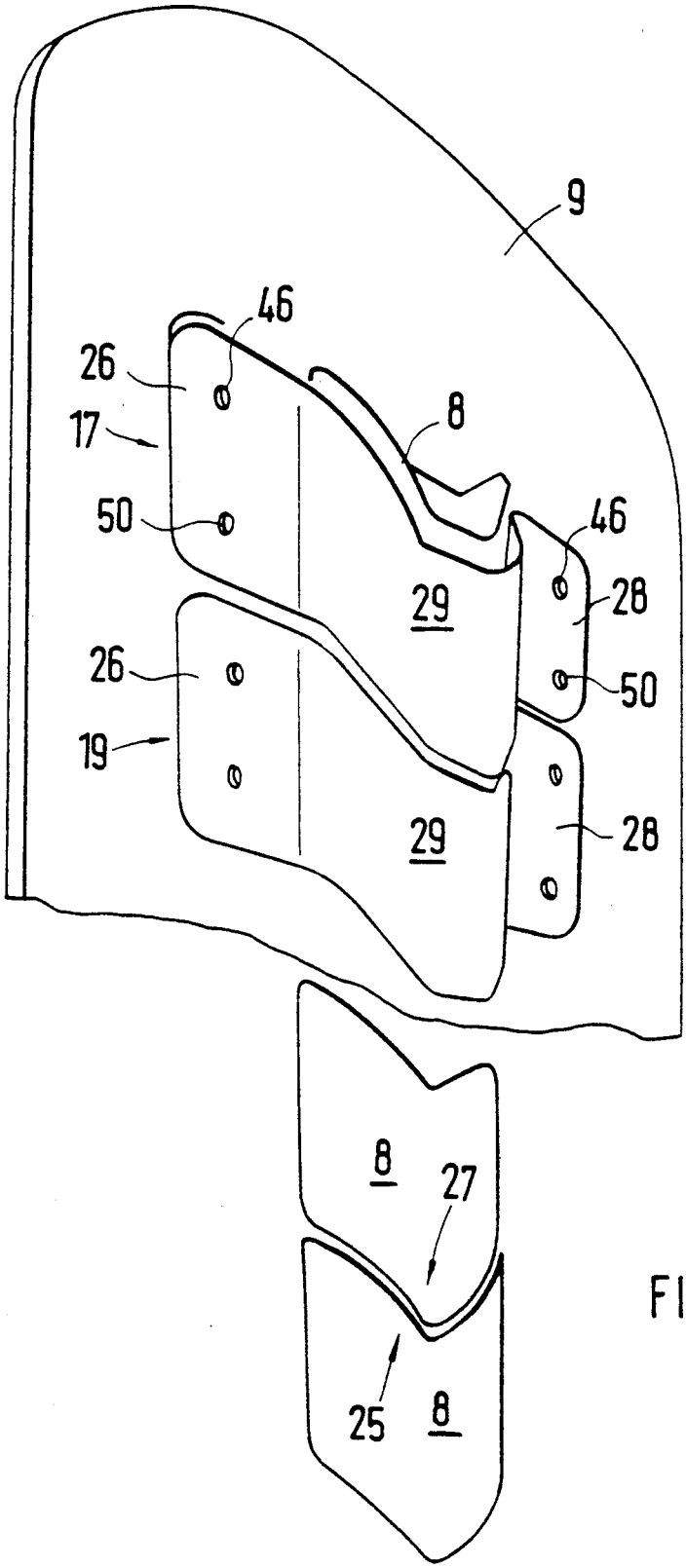
FIG. 7 is an enlarged view of a portion of the protective device for the spinal column in accordance with the embodiment shown in FIG. 6.
Figure 8:
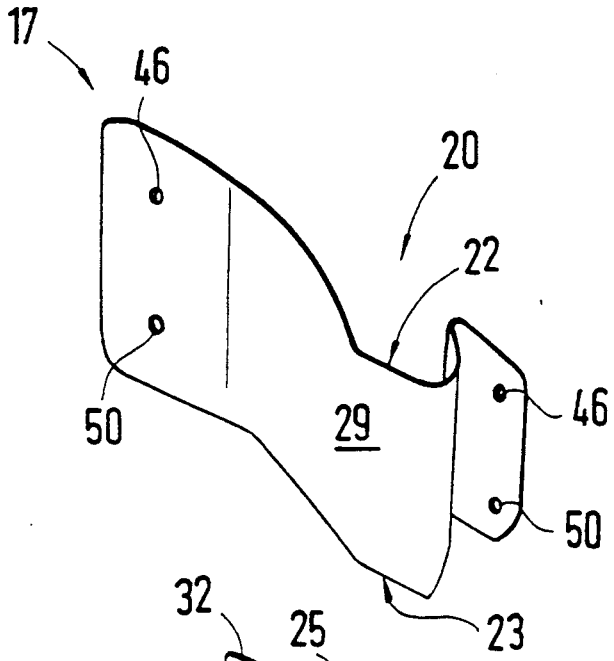
FIG. 8 is a perspective lateral view of a plate element in accordance with one embodiment of this invention.
Figure 9:
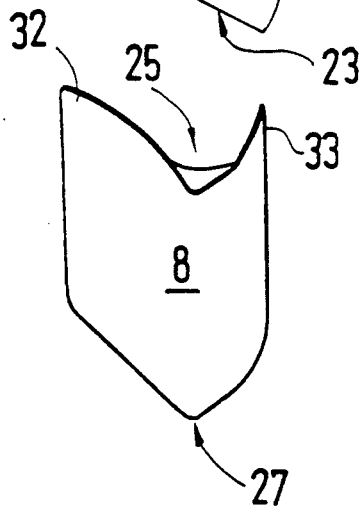
FIG. 9 is a perspective lateral view of a filler body in accordance with one embodiment of this invention.

FIGS. 6 and 7 show a protective device for the spinal column in accordance with another embodiment of this invention comprising basic body 9 made of an elastically deformable material and having a series of adjoining plate elements 17 and 19 and filler bodies 8. The plate elements 17 and 19 are made of elastically deformable plastic and have rivet pins 21 which can be inserted into the cut-outs 13. The free ends of the rivet pins, which are made of plastic, are heat-treated and deformed after the plate elements 17 and 19 have been attached, so that a fixed connection between the plate elements 17, 19 and the basic body 9 is formed.

Each of the plate elements 17, 19 has a cut-out 22 and a protrusion 23 shaped complementary to the cut-out 22, so that the adjacent plate elements 17, 19 are positively connected in at least one position of the protective device for the spinal column. It can be seen that the plate elements 17, 19 are essentially V-shaped when viewed from above.

The filler bodies 8 are shaped such that they fill the hollow space 20 between the basic body 9 and the corresponding plate elements 17. Each of the filler bodies 8 a cut-out 25 tapering in the direction of the basic body 9 with flanks 32, 33, as well as a projection 27, tapering towards the protrusion 23 of the plate element 17. Protrusion 27 is embodied complementary to the cut-out 25. The abutting surfaces of two adjoining filler bodies 8 fall off at an angle of approximately 45° towards the basic body 9. In this way, it is assured that there is overlapping of only the filler bodies, but not of the plate elements 17, 19. The filler bodies are surrounded on all sides by the plate elements, so that they can only be destroyed if the plate elements are destroyed or are extremely deformed.

I claim:

1. In a protective device for a spinal column having a plurality of plate elements positioned one behind another in a longitudinal direction of the spinal column, said plate elements being arched away from the spinal column, made of a deformable material and supported by a deformable basic body, said plate elements laterally extending beyond the spinal column and one of at least said plates partially overlapping and disposed at a short distance from each other, the improvement comprising:

the plate elements (14 to 19) and the basic body (9, 12) defining hollow spaces (20) between them, and said hollow spaces (20) filled with a shock-absorbing filler body (8, 11) of plastic foam.

2. In a protective device for the spinal column in accordance with claim 1, wherein the basic body (9, 12) has a basic body width which is greater than a plate element width of the plate elements (14 to 19), and the plate elements (14 to 19), and the plate elements (14 to 19) have a concave section (24, 29, 70), which is concavely arched away from said spinal column and receives the filler body and which is laterally adjoined by a plurality of legs (26, 28; 66, 68), each of which can be fixedly connected to the basic body (12).

3. In a protective device for the spinal column in accordance with claim 2, wherein an edge of the plate elements (14 to 19) which extends crosswise to a longitudinal extension (10) of the spinal column has a collar (30, 72), which is further from the basic body (12) than said concave section (24, 70) of the plate elements (14 to 19) and which partially receives and covers a crosswise-extending upper edge of the adjoining plate element.

4. In a protective device for the spinal column in accordance with claim 3, wherein the plate elements (14 to 19) are lined up without overlapping, the filler bodies (11) overlapping in an area of abutting places of the plate elements (14 to 19).

5. In a protective device for the spinal column in accordance with claim 4, wherein the plate elements (14 to 19) have a same shape.

6. In a protective device for the spinal column in accordance with claim 5, wherein the basic body (9, 12) is widened in a kidney area and has laterally extending legs (40, 41, 42).

7. In a protective device for the spinal column in accordance with claim 6, wherein covered basic body areas of the basic body (9, 12) covered by the plate elements (14 to 19) have a greater thickness than basic body areas extending beyond the plate elements (14 to 19).

8. In a protective device for the spinal column in accordance with claim 7, wherein the basic body (9, 12) comprises two coinciding pieces of a plastic foam fixedly connected to each other.

9. In a protective device for the spinal column in accordance claim 8, wherein said thickness of the basic body (9, 12) covered by the plate elements (14 to 19) and made of polyethylene foam is greater by approximately more than ⅓ than the thickness of the basic body (12) extending beyond the plate elements (14 to 18).

10. In a protective device for the spinal column in accordance with claim 9, wherein the plate elements (14 to 19) are shaped like lamellas and are riveted to the basic body (9, 12).

11. In a protective device for the spinal column in accordance with claim 10, wherein separate said filler bodies (8, 11) are secured in each said concave section (24, 29, 70) of the plate elements (14 to 19).

12. In a protective device for the spinal column in accordance with claim 10, wherein the filler bodies (8, 11) of the plate elements (14 to 19) are combined into a continuous strip forming hinges between the adjoining plate elements.

13. In a protective device for the spinal column in accordance with claim 12, wherein the filler body (11) extends over said plurality of lateral legs (26, 28; 66, 68) of the plate elements (14 to 18) and forms a flat connecting surface towards the basic body (12).

14. In a protective device for the spinal column in accordance with claim 13, wherein each of the concave sections (20) has a cut-out (22) and a protrusion (23) shaped complementary to the cut-out (22), whereby adjoining plate elements (17, 19) are positively connected in at least one position of the protective device for the spinal column.

15. In a protective device for the spinal column in accordance with claim 14, wherein the plate element (17) is essentially V-shaped when viewed from above.

16. In a protective device for the spinal column in accordance with claim 15, wherein the filler body (8) fills up the hollow space (20) between the basic body (9) and the plate element (17) and has a cut-out (25) tapering towards the basic body and a protrusion (27) tapering towards said plate element protrusion (23) of the plate element (17).

17. In a protective device for the spinal column in accordance with claim 16, wherein the protrusion (27) is shaped complementary to the cut-out (25).

18. In a protective device for the spinal column in accordance with claim 17, wherein an abutting surface between two adjoining filler bodies (8) falls off at an angle of approximately 45° toward the basic body (9).

19. In a protective device for the spinal column in accordance with claim 18, wherein said protective device is inserted into a jacket.

20. In a protective device for the spinal column in accordance with claim 19, wherein said protective device is a kidney belt.

21. In a protective device for the spinal column in accordance with claim 1, wherein an edge of the plate elements (14 to 19) which extends crosswise to a longitudinal extension (10) of the spinal column has a collar (30, 72), which is further from the basic body (12) than a concave section (24, 70) of the plate elements (14 to 19) and which partially receives and covers a crosswise-extending upper edge of the adjoining plate element.

22. In a protective device for the spinal column in accordance with claim 1, wherein the plate elements (14 to 19) are lined up without overlapping, the filler bodies (11) overlapping in an area of abutting places of the plate elements (14 to 19).

23. In a protective device for the spinal column in accordance with claim 1, wherein the plate elements (14 to 19) have a same shape.

24. In a protective device for the spinal column in accordance with claim 1, wherein the basic body (9, 12) is widened in a kidney area and has laterally extending legs (40, 41, 42).

25. In a protective device for the spinal column in accordance with claim 1, wherein covered basic body areas of the basic body (9, 12) covered by the plate elements (14 to 19) have a greater thickness than basic body areas extending beyond the plate elements (14 to 19).

26. In a protective device for the spinal column in accordance with claim 1, wherein the basic body (9, 12) comprises two coinciding pieces of a plastic foam fixedly connected to each other.

27. In a protective device for the spinal column in accordance with claim 1, wherein a thickness of the basic body (9, 12) covered by the plate elements (14 to 19) and made of polyethylene foam is greater by approximately more than ⅓ than the thickness of the basic body (9, 12) extending beyond the plate elements (14 to 19).

28. In a protective device for the spinal column in accordance with claim 1, wherein a side of the plate elements (14 to 19) oriented toward the basic body (9, 12) has one of a covering and a layer of tear-resistant, but deformable, material.

29. In a protective device for the spinal column in accordance with claim 1, wherein the plate elements (14 to 19) are shaped like lamellas and are riveted to the basic body (9, 12).

30. In a protective device for the spinal column in accordance with claim 1, wherein separate said filler bodies (8, 11) are secured in each concave section (24, 29, 70) of the plate elements (14 to 19).

31. In a protective device for the spinal column in accordance with claim 1, wherein the filler bodies (8, 11) of the plate elements (14 to 19) are combined into a continuous strip forming hinges between the adjoining plate elements.

32. In a protective device for the spinal column in accordance with claim 1, wherein the filler body (11) extends over a plurality of lateral legs (26, 28; 66, 68) of the plate elements (14 to 19) and forms a flat connecting surface towards the basic body (9, 12).

33. In a protective device for the spinal column in accordance with claim 1, wherein each of the concave sections (20) has a cut-out (22) and a protrusion (23) shaped complementary to the cut-out (22), whereby adjoining plate elements (17, 19) are positively connected in at least one position of the protective device for the spinal column.

34. In a protective device for the spinal column in accordance with one of claim 1, wherein the plate element (17) is essentially V-shaped when viewed from above.

35. In a protective device for the spinal column in accordance with claim 1, wherein the filler body (8) fills up the hollow space (20) between the basic body (9) and the plate element (17) and has a cut-out (25) tapering towards the basic body and a protrusion (27) tapering towards a plate element protrusion (23) of the plate element (17).

36. In a protective device for the spinal column in accordance with claim 1, wherein the protrusion (27) is shaped complementary to a cut-out (25).

37. In a protective device for the spinal column in accordance with claim 1, wherein an abutting surface between two adjoining filler bodies (8) falls off at an angle of approximately 45° toward the basic body (9).

38. In a protective device for the spinal column in accordance with claim 1, wherein said protective device is inserted into a jacket.

39. In a protective device for the spinal column in accordance with claim 1, wherein said protective device is a kidney belt.

40. In a protective device for a spinal column having a plurality of plate elements positioned one behind another in a longitudinal direction of the spinal column, said plate elements being arched away from the spinal column, made of a deformable material and supported by a deformable basic body, said plate elements laterally extending beyond the spinal column and one of at least said plates partially overlapping and disposed at a short distance from each other, the improvement comprising:

the plate elements (14 to 19) lie on the basic body (8, 12) with almost their entire surfaces and are made of shock-absorbing plastic foam.

* * * * *